US005918786A

United States Patent [19]

Wise

[11] Patent Number: 5,918,786

[45] Date of Patent: Jul. 6, 1999

[54] HANDCUFF CONTAINER

[76] Inventor: Michael R. Wise, 11470 S.W. St., Miami, Fla. 33173

[21] Appl. No.: 08/876,793

[22] Filed: Jun. 16, 1997

[51] Int. Cl.[6] ..... A45F 5/00

[52] U.S. Cl. ..... 224/681; 224/682; 224/236; 224/673; 224/914

[58] Field of Search ..... 224/914, 431, 224/191, 660, 663, 665, 666, 671, 673, 674, 676, 680, 684, 235, 236, 250, 255, 256; D3/222, 226, 230; 70/16; 206/349

[56] References Cited

U.S. PATENT DOCUMENTS

| | | | |
|---|---|---|---|
| D. 238,629 | 2/1976 | Tibbetts | D3/226 |
| 666,687 | 1/1901 | Orndorff | 224/931 |
| 1,170,259 | 2/1916 | Hooper | 224/931 |
| 1,416,238 | 5/1922 | Seiler | 224/681 |
| 1,478,497 | 12/1923 | Welch | 224/682 |
| 1,562,641 | 11/1925 | Hodgson | 224/236 |
| 2,324,194 | 7/1943 | Campiglia | 224/236 |
| 2,346,185 | 4/1944 | Perry | 224/684 |
| 3,769,733 | 11/1973 | Nelson | 224/673 |
| 3,870,208 | 3/1975 | Theodore | 224/914 |
| 4,705,086 | 11/1987 | O'Neill | 224/681 |
| 4,840,048 | 6/1989 | Elam | 70/16 |
| 4,921,153 | 5/1990 | Smith | 224/683 |
| 5,209,385 | 5/1993 | Ledesma | 224/681 |

*Primary Examiner*—Allan W. Shoap
*Assistant Examiner*—Gregory M. Vidovich
*Attorney, Agent, or Firm*—Baker & Botts, L.L.P.

[57] ABSTRACT

A handcuff container (1) is made of pieces (3, 4, 5) of material that are connected together to form compartments (13, 19) between the pieces into which a pair of handcuffs may be held. One of the handcuffs (the "inner" handcuff) is held in the inner compartment (13) which is formed by the two inner pieces (3, 4), and the second handcuff (the "outer" handcuff) is held in the outer compartment (19) which is formed by fastening the two outer pieces (4, 5) to each other using a releasable fastener (22A, 22B). When thus held in place, the outer handcuff is partially exposed. The handcuff container (1) can be attached to a user's belt (7) or equipment. Using a natural forward motion, the user, such as a law enforcement or security officer, grabs onto the outer handcuff which wedges between the outer two pieces (4, 5) that make up the outer compartment (19) and releases the fastener. The compartments (13, 19) are contoured so that when the user withdraws the handcuffs, the handcuffs are consistently in the proper position in the user's hand and need not be repositioned. When the handcuff pair is in the container, the locking mechanism (17) of the outer handcuff rests within the recessed opening of the inner handcuff keeping the profile of the container thin both for the comfort of the user and to better conceal the container.

9 Claims, 2 Drawing Sheets

HANDCUFF CONTAINER

FIELD OF THE INVENTION

This invention relates to a container and more particularly an apparatus which independently holds handcuffs in a uniform manner so as to allow for the quick access and removal of the handcuffs with no further need to reposition the handcuffs for immediate application.

BACKGROUND OF THE INVENTION

It is common knowledge that law enforcement and security officers are generally required to carry handcuffs as a means to restrain persons and to increase personal safety. Given the immediacy of the circumstances involving the apprehension and detention of persons, the handcuffs must be easily and quickly accessible. Additionally, the handcuffs are preferably carried in a position which allows the handcuffs to be withdrawn for immediate application.

There are a number of handcuff containers which provide for the carrying of the handcuffs on the belt of the wearer. Generally these containers consist of a pouch which typically has a cover that is held in a closed position by means of a snap fastener. The disadvantage of these closed pouch containers is that the user must first unsnap and lift the cover thereby slowing access to the handcuffs. Another disadvantage is that the user must adjust the handcuffs in the user's grasp prior to application of the handcuffs.

Other containers for carrying handcuffs have proposed as a main objective a means by which the handcuffs can be carried by the user in such a manner as to allow for quick accessibility and ease of use of the handcuffs. Examples of these proposed handcuff cases include U.S. Pat. Nos. 1,413,290, 1,517,588, 1,894,540, 3,870,208, 3,862,414, 4,852,784 and 5,351,868.

The disadvantages of both the closed pouch containers and other containers have resulted in the carrying of handcuffs either draped over the belt of the wearer or by the placing of one cuff inside the waistband of the wearer with the other cuff loosely hanging on the outside of the waistband. The disadvantages of this method of carrying handcuffs are that the loose cuff can bounce around creating noise and can also cause discomfort to the wearer. Another disadvantage of this method of carrying handcuffs is that they are easily caught on the belt or waistband of the wearer, thus increasing the time for use and creating a potential safety concern for the user.

It is therefore the objective of this present invention to provide a container for handcuffs which allows the user quick and easy access to the handcuffs while also providing a comfortable container to hold the handcuffs.

It is another object of this invention to securely separate the handcuffs into separate compartments so as to reduce rattling noises caused by one cuff coming into contact with the other cuff.

It is another object of this invention to provide a container for handcuffs which securely holds the handcuffs in a predetermined position which allows for the handcuffs to be removed with the natural motion of the hand and arm so that the handcuffs are in the proper position for placing the handcuffs on the wrist of a person without the user having to adjust the handcuffs in the user's hand.

It is another object of this invention to provide a handcuff container which is specifically made to be worn on the user's left or right side based upon the choice of the user.

It is another object of this invention to provide a handcuff container which alleviates the complications and disadvantages of the more conventional handcuff pouch.

SUMMARY OF INVENTION

According to the aforementioned and other objects, the present invention provides a handcuff container that separates each of the cuffs creating two individual compartments. The compartments are contoured to the shape of the handcuffs so as to securely hold the handcuffs. One handcuff is partially exposed for easy access and quick removal. Having a left or right design enables the user to attach the container on the user's dominant side or side of choice so as to correspond to the user's personal preference and individual training. Removal of the handcuffs from the container corresponds to the natural forward motion of the user's arm and hand. The uniform placement of the handcuffs in the case allows the user to grasp the handcuffs in the same position each time the handcuffs are removed from the container. The handcuffs, once removed from the container, are consistently in the proper position in the user's grasp for immediate use.

In its preferred form, the present handcuff container consists of four pieces of leather or other similar moldable material forming two independent compartments with a snap further securing the handcuffs in the container. The handcuffs are positioned in the container so that one cuff is placed into the inner compartment of the container and the other cuff is placed into the outer compartment of the container. The handcuffs are then secured into the individual compartments by the use of a releasable snap fastener. The frame portion of the outer cuff is exposed to facilitate the use of the user's fingers to pull the outer cuff forward thereby detaching the snap and allowing the user's to grasp the handcuffs. The force of the forward motion utilized in extracting the handcuffs releases the snap so that the handcuffs become simultaneously free for application thereby alleviating the need to release the snap prior to grasping the outer handcuff.

The primary advantage of the present invention is that the handcuffs are easily accessed and removed from the container in a position so that the user does not need to reposition the handcuffs in the user's hand before application of the handcuffs to the wrist of a person.

Other objects and advantages of the present invention will become apparent from the following detailed description and drawings.

DESCRIPTION OF PREFERRED EMBODIMENTS

Figure 1:
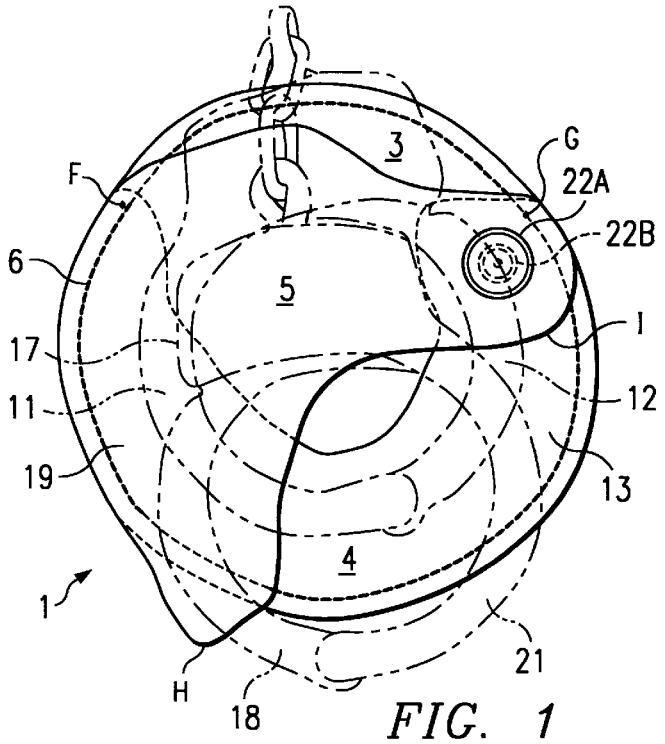
FIG. 1 is a front sectional view of the handcuff container showing the position of the handcuffs in their respective separate compartments.

Referring to the drawings, FIG. 1 illustrates the front view of the preferred form of the present invention, generally designated 1.

Figure 2:
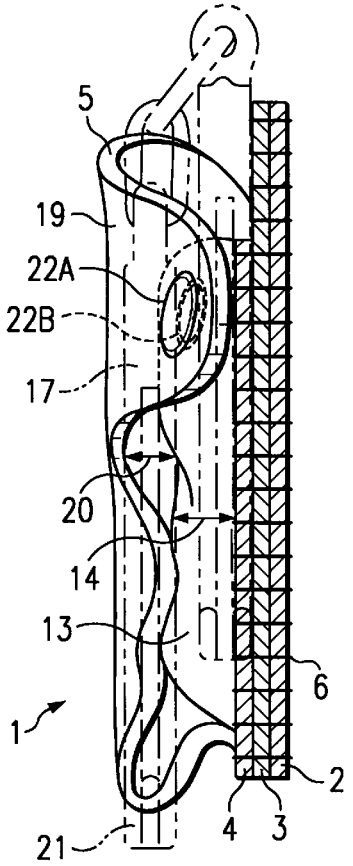
FIG. 2 is a side sectional view of the handcuff container.

Referring to FIG. 2 the case is formed of four pieces preferably constructed of 7 ounce to 8 ounce leather or other similar moldable material. Referring again to FIG. 2 each piece 2, 3, 4, 5 of the fully assembled container 1 is stitched together on the marginal edges with a binding 6.

Figure 3:
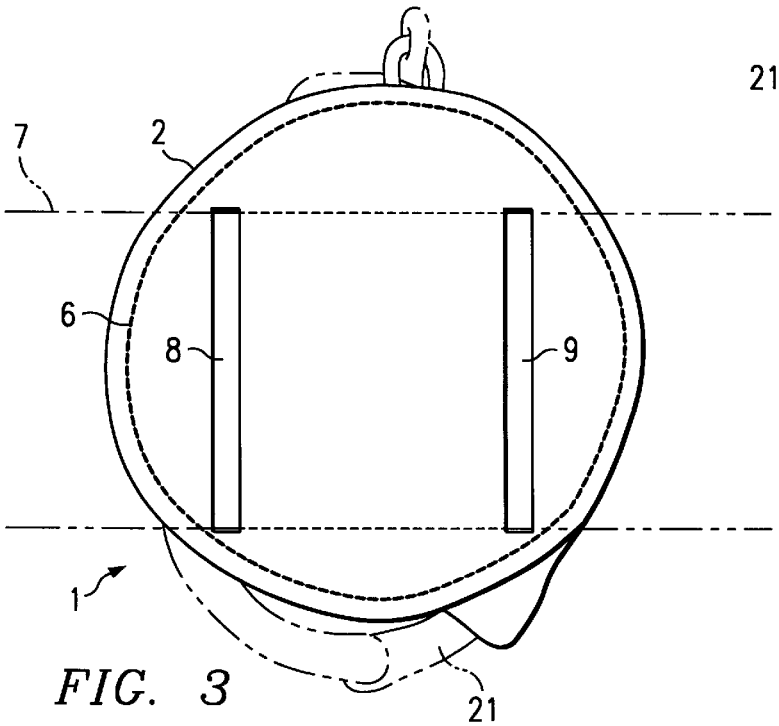
FIG. 3 is a back view of the handcuff container with handcuffs as mounted on the belt through integral slots.

Referring to FIG. 3 the attaching piece 2 allows for the handcuff container to be mounted to the belt 7 or equipment of the user by means of integral slots 8 and 9 or other attaching means such as loops, clips, snaps or other releasable fasteners so as to securely hold the container.

Referring to FIG. 2 the inner compartment piece 3 forms a divider which separates the attaching piece 2 from the inner compartment of the container so that the means of mounting the container does not interfere with the extraction of the handcuffs from the case.

Figure 4:
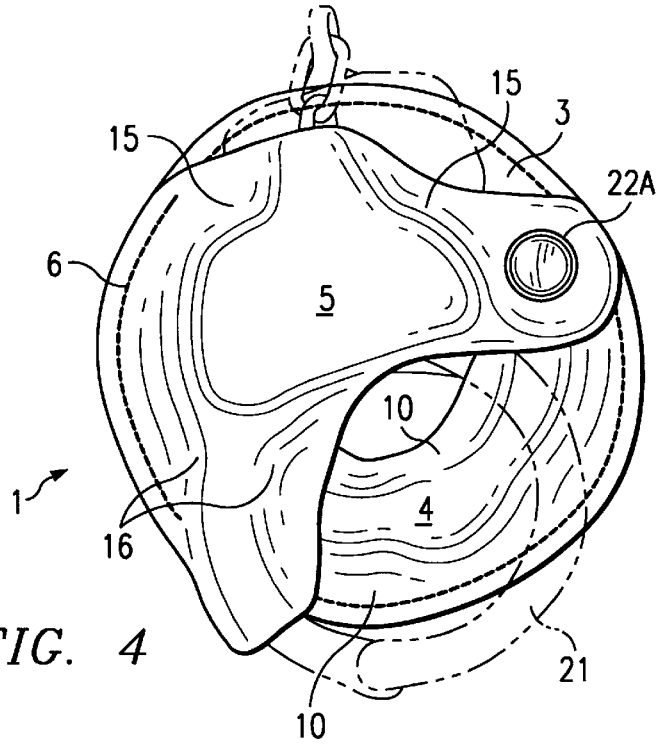
FIG. 4 is a front view of the handcuff container shown with handcuffs.
Figure 5:
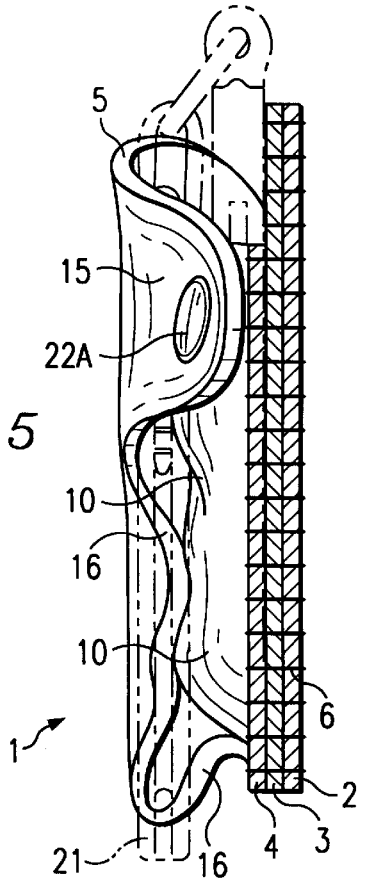
FIG. 5 is a side view of the handcuff container with handcuffs.

Referring to FIGS. 1, 2 and 4, piece 4 is contoured 10 to the shape of the frame 11 and jaw 12 portion of the handcuff forming the inner compartment 13. The compartment 13 provides an opening of sufficient width extending from point F of opening 14 to point G thereof to securely hold the handcuff while allowing the handcuff to be easily and quickly extracted from the inner compartment.

Referring to FIGS. 1, 2 and 4, piece 5 is contoured 15 and 16 to the shape of locking mechanism portion 17 and jaw portion 18 of the handcuff forming the outer compartment 19. The compartment provides an opening extending from point H of opening 20 to point I thereof, such that the frame portion 21 of the outer handcuff is partially exposed.

Referring to FIG. 2 the individual compartments 13 and 19 of the container 1 are contoured to the shape of conventional handcuffs and form compartments having openings 14, 20 of sufficient width to permit the entry of each handcuff into the compartments so that the cuffs are securely held without slippage or making rattling noises.

Referring to FIG. 1 the handcuffs are positioned in the container 1 so that inner handcuff is placed into the respective compartment 13 of the container with the frame portion 11 facing to the right and the jaw portion 12 facing to the left of the container. The outer handcuff is placed into the respective compartment 19 of the container with the frame portion 21 facing to the left and the jaw portion 18 facing to the right of the container. Referring to FIGS. 1 and 2, the locking mechanism 17 of the outer handcuff rests in the recessed opening of the inner handcuff. This offset positioning of the handcuffs in their respective compartments 13 and 19 allows for the case to have a thinner profile in order to be more comfortable and to better conceal the handcuffs.

Referring to FIGS. 1 and 2, the handcuffs are secured in the compartments 13 and 19 by the use of a conventional type releasable snap fastener 22A, 22B. The exposure of the frame portion 21 of the outer handcuff between openings H and I facilitates the use of the user's fingers to pull the outer cuff through pieces 4 and 5 thereby detaching the releasable snap fastener 22A, 22B. The releasable snap fastener 22A, 22B is positioned such that the exposed frame portion 21 of the outer cuff is pulled through and wedges between pieces 4 and 5, thereby detaching the snap fastener and allowing the user to grasp the handcuffs easily and quickly in the same position each time.

From the foregoing description and the drawings, it is apparent that piece 5 is attached to pieces 2, 3, and 4 only along the rear edge (to the left in FIG. 1), and that the upper and lower edges of piece 5 are unattached. When snap fastener 22A, 22B at the front edge is released by the aforementioned wedging action, the frame 21, jaw 18, and locking mechanism 17 portions of the outer cuff are free to be lifted upwardly, whereupon the frame 11 and jaw 12 portions of the inner handcuff are lifted out of inner compartment 13 through the upper opening F–G.

While a preferred embodiment of the handcuff container has been particularly described, the invention may otherwise be embodied within the scope of the appended claims.

What is claimed is:

1. A container for holding a pair of handcuffs, the pair having first and second handcuffs, the container comprising:

first and second pieces of flexible sheet material, each having an upper edge, a lower edge, a front edge and a rear edge, the lower, front and rear edges of the first and second pieces being fastened together to form a first compartment and the upper edges of the first and second pieces being unattached so as to leave an upper opening for acceptance of the first handcuff into the first compartment;

a third piece of flexible sheet material having an upper edge, a lower edge, a front edge, and a rear edge, the rear edge of the third piece being fastened to the rear edge of the second piece, and the upper and lower edges of the third piece being free of attachment to the first and second pieces of flexible sheet material, and a releasable fastener joining the front edge of the third piece to the front edge of the second piece so as to form a second compartment for receiving the second handcuff when the releasable fastener is attached, the third piece being shaped and dimensioned such that a portion of a frame of the second handcuff is exposed along portions of the container adjacent the front and lower edges of the third piece when the second and third pieces are joined by the fastener for grasping by a user to facilitate removal of the handcuff pair from the container.

2. The handcuff container according to claim 1, wherein the first compartment is shaped and dimensioned so as to securely hold the first handcuff.

3. The handcuff container according to claim 1, wherein the releasable fastener is a snap fastener.

4. The handcuff container according to claim 2, wherein when the fastener is connected and the second handcuff is in the container, forward motion of the second handcuff forces the releasable fastener to release by a wedging action between the second and third pieces.

5. The handcuff container according to claim 2, and further comprising means attached to the first piece on a surface thereof opposite from the second piece for attaching the container to equipment worn by a user.

6. The handcuff container according to claim 5, wherein the means for attaching the container to equipment includes a fourth piece of a flexible sheet material forming slots for receiving a belt worn by the user.

7. The handcuff container according to claim 1, wherein said compartments are configured for holding said handcuffs in a uniform manner such that said handcuffs can be repeatedly withdrawn from said container in the same position that said handcuffs are properly positioned in the user's hands without the need for repositioning.

8. The handcuff container according to claim 1, wherein the first and second compartments are shaped and dimensioned so that a frame and jaw portion of said second handcuff is positioned offset below a frame and jaw portion of said first handcuff when said handcuff pair is in said container.

9. The handcuff container according to claim 1, wherein the first and second compartments are shaped and dimensioned so that a locking mechanism of the second handcuff rests within a recessed opening of said first handcuff so as to reduce the thickness of the container for the comfort of the user and to better conceal the handcuff pair.

* * * * *